US007375945B2

(12) United States Patent
Izumi et al.

(10) Patent No.: US 7,375,945 B2
(45) Date of Patent: May 20, 2008

(54) ION GENERATOR

(75) Inventors: Kenkichi Izumi, Yokohama (JP); Jianmin Si, Yokohama (JP)

(73) Assignee: Shishido Electrostatic, Ltd., Tokyo (JP)

( * ) Notice: Subject to any disclaimer, the term of this patent is extended or adjusted under 35 U.S.C. 154(b) by 242 days.

(21) Appl. No.: 10/558,207

(22) PCT Filed: Jun. 2, 2004

(86) PCT No.: PCT/JP2004/008016

§ 371 (c)(1),
(2), (4) Date: Nov. 25, 2005

(87) PCT Pub. No.: WO2004/109875

PCT Pub. Date: Dec. 16, 2004

(65) Prior Publication Data

US 2006/0232908 A1 Oct. 19, 2006

(30) Foreign Application Priority Data

Jun. 5, 2003 (JP) ..... 2003-160873

(51) Int. Cl.
*H01T 23/00* (2006.01)

(52) U.S. Cl. ..... 361/231

(58) Field of Classification Search ..... 361/231
See application file for complete search history.

(56) References Cited

U.S. PATENT DOCUMENTS 2,141,869 A * 12/1938 Konig ..... 219/384
2,924,759 A * 2/1960 Maaz ..... 257/426
4,816,684 A * 3/1989 Breton ..... 250/423 R
4,975,579 A * 12/1990 Iwanaga ..... 250/324
5,655,186 A * 8/1997 Godlove et al. ..... 399/171
6,843,969 B1 * 1/2005 Anno ..... 422/186.04

FOREIGN PATENT DOCUMENTS

| | | |
|---|---|---|
| JP | 8-88073 | 4/1996 |
| JP | 8-288094 | 11/1996 |
| JP | 2003-22897 | 1/2003 |

* cited by examiner

*Primary Examiner*—Ronald W. Leja
(74) *Attorney, Agent, or Firm*—Paul A. Guss

(57) ABSTRACT

In an ion generator comprising a discharge needle 2, an opposed electrode 3 opposite the discharge needle 2 and an AC high voltage power source 4, for generating positive and negative air ions by giving rise to a corona discharge when a high voltage is applied by the AC high voltage power source 4 between the discharge needle 2 and the opposed electrode 3, the AC high voltage power source 4 comprises a high frequency oscillator 7 and a piezoelectric transformer 9, and outputs a high frequency voltage. An insulator 5 is placed intervening between the high voltage output line 4*a* of the AC high voltage power source 4 and the discharge needle 2 to capacitance-couple them, and the discharge needle 2 is enabled to discharge electricity. Preferably, the surface of the opposed electrode 3 should be covered with an insulator. This enables the balance between positive and negative air ions and its stability to be improved while reducing the hardware configuration in size and weight.

11 Claims, 10 Drawing Sheets

ION GENERATOR

CROSS-REFERENCE TO RELATED APPLICATIONS

This application is a U.S. national phase application of PCT International Patent Application No. PCT/JP04/08016 filed on Jun. 2, 2004 and claiming the benefit of priority of Japanese Patent Application No. 2003-160873 filed on Jun. 5, 2003.

TECHNICAL FIELD

The present invention relates to an ion generator which generates by corona discharge positive and negative air ions suitable for neutralizing the static electricity of and deelectrifying a charged object.

BACKGROUND ART

There is already known an ion generator which applies a high voltage from an AC high voltage source of the commercial frequency (50 or 60 Hz) between a discharge needle and an opposed electrode, generates a corona discharge from the discharge needle and ionizes air by that corona discharge (see Japanese Patent Application Laid-Open No. 8-288094 for instance).

In an ion generator of this kind, positively charged air ions and negatively charged air ions are alternately generated by alternately applying an AC voltage to the discharge needle. And the ion generator of this kind, as it can neutralize the electric charges (static electricity) accumulated on the charged object with the generated positive and negative air ions, is generally used as a deelectrifying device for clearing charged objects of static electricity.

Further, a consideration is given in the ion generator of this kind to the short-circuiting current which may be generated when a human body or the like comes into contact with the discharge needle, and the short-circuiting current is restrained by capacitance-coupling the discharge needle with the high voltage output line from the AC high voltage source. In the ion generator in this case, at the time of generation of a corona discharge (at the time of discharge by the discharge needle) the impedance of the coupled capacitance of the discharge needle causes the discharge needle to reduce the voltage of the high voltage output line. In order to generate a corona discharge at the commercial frequency, the discharge needle requires a voltage of about 4 kV at its tip. For this reason, this ion generator uses an AC high voltage power source which outputs a high voltage, augmented with a compensation for the voltage drop due to the impedance of the coupled capacitance of the discharge needle, to the high voltage output line.

It is difficult here for the discharge needle to have a very large coupled capacitance because of structural constraints and the need to secure the effect to restrain the short-circuiting current, and the capacitance can be at most 10 pF or so for practical purposes. As a result, the voltage drop attributable to this coupled capacitance increases. In a case in which coupled capacitance is 10 pF and the commercial frequency is 50 Hz, the voltage drop will reach about 1.6 kV. Incidentally, the discharge current of the discharge needle is about 3 μA to 10 μA, and the above-mentioned level of the voltage drop is what matches a discharge current of 5 μA. Therefore, in order to compensate for this voltage drop, the conventional ion generator uses as the boosting transformer for the AC high voltage power source a wound-wire transformer having a sufficient number of windings to generate a high voltage of about 6 to 9 kV. However, since a wound-wire transformer is relatively large and heavy, this involves a problem of difficulty to make the ion generator compact and light.

On the other hand, there is also known an ion generator using a piezoelectric transformer, which is more compact and lighter than a wound-wire transformer and an AC high voltage power source of a high frequency of a few tens of kHz instead of the commercial frequency (see Japanese Patent Application Laid-Open No. 2003-22897 for instance). The AC high voltage power source of this ion generator generates a high frequency AC high voltage by providing a high frequency signal of a few tens of kHz from a high frequency oscillator to the piezoelectric element of the piezoelectric transformer. An ion generator using such a high frequency power source, compared with what uses a power source of the commercial frequency, can improve the ion balance of air ions (the balance between the quantity of positive ions and that of negative ions), and moreover can reduce the voltage needed for generating a corona discharge from the tip of the discharge needle to about 1.8 kV.

The output voltage of the high frequency power source using this piezoelectric transformer is at most about 2 to 3 kV because of the characteristics of the piezoelectric transformer, and this output voltage is close to the voltage (about 1.8 V) needed by the discharge needle to generate a corona discharge by using that high frequency power source. Therefore, in order to secure the voltage of the discharge needle at a level allowing the generation of a corona discharge, the voltage drop from the high frequency power source to the discharge needle has to be kept sufficiently small. As the current a piezoelectric transformer can output is generally small (at most about 100 μA), the short-circuiting current can be kept sufficiently small without having to capacitance-couple the discharge needle with the high voltage output line.

On account of these circumstances, in the conventional ion generator using a high frequency power source, the high voltage output line is directly connected to the discharge needle (the discharge needle is not capacitance-coupled with the high voltage output line) so that no superfluous voltage drop may occur between the high voltage output line of the high frequency power source and the discharge needle.

Incidentally, the requirement for neutralizing charged objects wherever practicable on the production lines of precision semiconductor devices and elsewhere has become even more stringent in recent years. In meeting this requirement, an ion generator using a high frequency power source is more advantageous than an ion generator using a commercial frequency power source. However, in the conventional ion generator using a high frequency power source, the ion balance is often destabilized, and the requirement cannot be always fully satisfied.

An object of the present invention, attempted in view of these background circumstances, is to provide an ion generator reduced in the size and weight of hardware configuration and capable of improving the balance between positive and negative air ions and its stability.

DISCLOSURE OF THE INVENTION

The invention, intended to achieve the foregoing object, relates to an ion generator comprising at least one discharge needle, an opposed electrode opposite the discharge needle, and an AC high voltage power source for applying a high voltage between the discharge needle and the opposed electrode, for generating positive and negative air ions by giving rise to a corona discharge when a high voltage is applied between the discharge needle and the opposed electrode by the AC high voltage power source.

To achieve the foregoing object, the inventors pertaining to the present application conducted various studies and experiments. As a result, the inventors found that, in an ion generator provided with a high frequency AC power source equipped with a piezoelectric transformer, even if the discharge needle was capacitance-coupled with the high voltage output line of the high frequency AC power source, an AC corona discharge could be satisfactorily generated from the discharge needle while sufficiently reducing the drop of the voltage from the high voltage output line from the high frequency AC power source to the discharge needle and that at the same time the capacitance coupling could serve to balance the quantities of the positive and negative air ions and to stabilize that balance compared with the conventional high frequency ion generator, thereby improving the ion balance.

Therefore, the present invention uses an AC high voltage power source comprising a high frequency oscillator and a piezoelectric transformer and outputs a high frequency voltage, and an insulator is placed to intervene between the high-voltage output line of the AC high-voltage power source and the discharge needle to enable the discharge needle to accomplish discharging.

According to the invention configured in this way, the intervening presence of the insulator between the high voltage output line and the discharge needle results in capacitance coupling of the high voltage output line and the discharge needle by the insulator. And by using what outputs a high frequency voltage as the AC high voltage power source and capacitance-coupling the high voltage output line and the discharge needle with the insulator, the quantities of positive and negative air ions can be balanced and the balance can be stabilized, namely the ion balance can be improved, compared with the conventional ion generator which uses the commercial frequency voltage or the conventional high frequency type ion generator in which the high voltage output line and the discharge needle are directly connected. In this case, the ion balance can be improved while setting the capacitance between the discharge needle and the high voltage output line to such a value that the voltage drop due to that capacitance would be sufficiently reduced. Since the AC high-voltage power source is a high frequency power source provided with a high frequency oscillator and a piezoelectric transformer, the hardware can be reduced in size and weight compared with a commercial frequency high voltage power source equipped with a wound-wire transformer. Furthermore, as it uses an AC high voltage power source provided with a piezo electric transformer, the short-circuiting current of the discharge needle can be sufficiently restrained.

The form of the intervening presence conceivable here of the insulator between the discharge needle and the AC high voltage power source (the structural form of coupling capacitance) may be one of the following two forms for instance.

In a first mode, the high voltage output line of the AC high voltage power source is covered with an insulating tube as the insulator, the high voltage output line covered with this insulating tube is inserted into a current collector ring formed of a conductor in a state in which the high voltage output line is insulated from the current collector ring by the insulating tube, and conduction is established between the surface of the current collector ring into which the high voltage output line is inserted and the discharge needle.

In the first mode, since the high voltage output line and the discharge needle are capacitance-coupled by the insulating tube covering the high voltage output line and the current collector ring into which these are inserted, the structure of the coupling capacitance can be simplified.

In a second form, conduction of the discharge needle is established with a first conductor pattern formed on one face of a plate-shaped insulator as the insulator, and conduction of the high voltage output line is established with to a second conductor pattern formed on the other face of the plate-shaped insulator in a position matching the first conductor pattern.

In the second mode, a parallel plate condenser functioning with a plate-shaped insulator serving as a dielectric and a conductor pattern disposed on each face of the insulator serving as an electrode is formed, and the parallel plate condenser capacitance-couples the discharge needle and the high voltage output line. In this case, since each conductor pattern can be readily formed of, for instance, a metal member melt-fastened onto a face of the plate-shaped insulator or a circuit pattern (pattern of a conductive thin film layer) printed on a face of the plate-shaped insulator, capacitance coupling of the discharge needle and the high voltage output line can be accomplished in a low cost simple structure by using a circuit board or the like as the plate-shaped insulator.

Where a plate-shaped insulating member is to be used as in the foregoing case and a plurality of discharge needles of the above-described kind are provided, the first conductor pattern comprises a plurality of partial conductors establishing conduction of the discharge needles with one another arranged on one face of the plate-shaped insulator in a pattern in which the partial conductors are insulated from one another by said plate-shaped insulator and matched with the arrangement of the plurality of discharge needles, and the second conductor pattern comprises a plurality of partial conductors opposite the partial conductors of the first conductor pattern via the plate-shaped insulator and a partial conductor linking the plurality of partial conductors in conduction with one another.

According to this, the discharge needles and the high voltage output line are capacitance-coupled partially (in the part of the plate-shaped insulator) between the partial conductors of the first conductor pattern matching the discharge needles and the partial conductors of the second conductor pattern opposed to those partial conductors. In this case, the high-voltage output line is capacitance-coupled with the discharge needles while establishing conduction to only part of the second conductor pattern. It is also possible to use only one plate-shaped insulator, instead of providing one plate-shaped insulator for every discharge needle, and capacitance-couple each discharge needle to the high voltage output line. Therefore, where a plurality of discharge needles are to be disposed, each of the discharge needles can be capacitance-coupled with the high voltage output line in a compact and simple structure.

Where a plurality of discharge needles and a plate-shaped insulator are provided as described above, the discharge needles are arranged in the following way for instance. Thus, the plurality of discharge needles, with the base end of each being fixed to the partial conductors of the first conductor pattern of the plate-shaped insulator, are laid extending around the plate-shaped insulator in a pattern of arrangement radiating from the plate-shaped insulator. And the opposed electrode is composed of an annular conductor so arranged around the plurality of discharge needles as to have an axis in a direction substantially orthogonal to the axis of each discharge needle.

As this configuration enables the electric fields between the opposed electrode and the discharge needles to be uniformized for every discharge needle, it is made possible to restrain fluctuations in the state of generation of air ions by the discharge needles. Further, on account of the presence of the opposed electrode around the plurality of discharge needles radially extending from the plate-shaped insulator, when these discharge needles and opposed electrode are to be housed in a case, the plate-shaped insulator is necessarily arranged near the central part of the inner space of the case. For this reason, the capacitance between the second conductor pattern of the plate-shaped insulator to which a high voltage is applied and the high voltage output line whose conduction to the pattern or the case can be kept small, thereby to keep small any leak current between the second conductor pattern and the high voltage output line or the case.

Further, according to the present invention described above, preferably the opposed electrode facing the discharge needles is covered with an insulator. Since the opposed electrode opposite the discharge needles are covered with the insulator in this configuration, the insulator functions between the discharge needles and the opposed electrode as a capacitance connected to the opposed electrode. As a result, the quantity of air ions directed from the vicinities of the tip of the discharge needles toward the opposed electrode is restrained from becoming predominantly positive or negative, and the ion balance of the positive and negative air ions that can be discharged can be further improved.

Further, especially where a plurality of radially extending discharge needles are provided, preferably the opposite electrode which is the annular conductor is fitted to the outer circumference of a cylindrical insulator, the cylindrical insulator accommodating therein a plurality of the discharge needles and the plate-shaped insulator and being arranged coaxially with the annular conductor, and comprises, within the cylindrical insulator, means of supplying air in the axial direction thereof.

This makes it possible for the cylindrical insulating member to readily constitute an insulator to cover the annular opposed electrode and to uniformize the positional relationship between the cylindrical insulating member and the discharge needles for every discharge needle. In this case incidentally, the ions generated in the cylindrical insulator can be delivered out of the cylindrical insulator by supplying air into the cylindrical insulator in the axial direction thereof.

BEST MODES FOR CARRYING OUT THE INVENTION

A first mode for carrying out the present invention will be described below with reference to FIG. 1 through FIG. 4.

Figure 1:
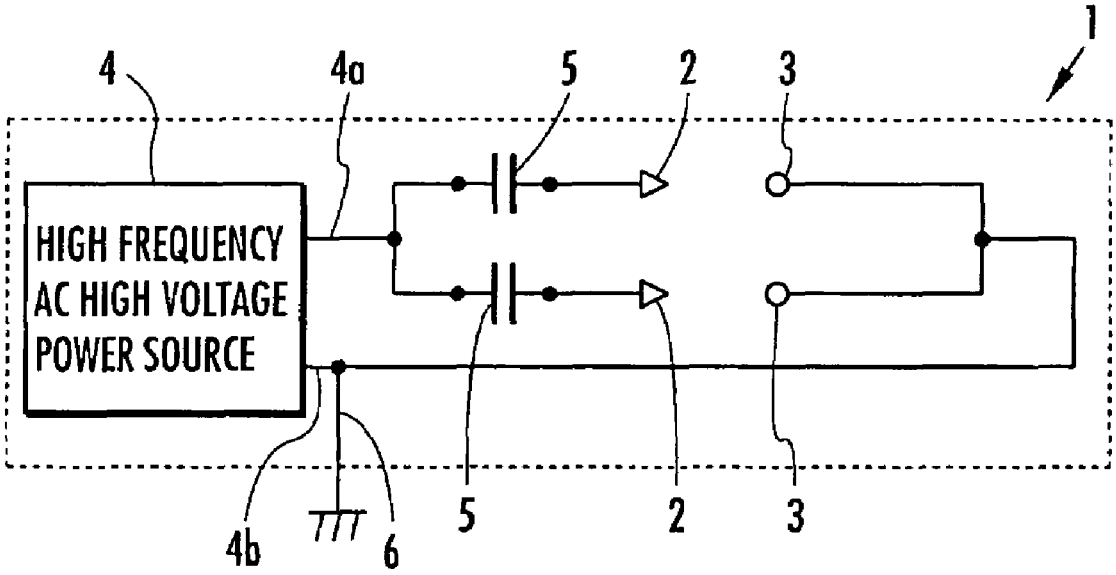
FIG. 1 is a circuit diagram showing an outline of an ion generator in a first mode for implementing the present invention.

Referring to FIG. 1, an ion generator 1 in the first mode for carrying out the invention comprises discharge needles 2, opposed electrodes 3 opposite the discharge needles 2, a high frequency AC high voltage power source 4 and condenser units (capacitance units) 5 as its electrical circuit configuration.

Although two each of the discharge needles 2 and the opposed electrodes 3 are shown in FIG. 1, at least one each could suffice. The number of the discharge needles 2 and that of the opposed electrodes 3 need not be equal, but one opposed electrode 3 may be disposed opposite a plurality of discharge needles 2.

An output cable (high voltage output line) 4*a* of the high frequency AC high voltage power source 4 is connected to the discharge needles 2 via the condenser units 5. The opposed electrodes 3 are connected to a return cable 4*b* of the high frequency AC high voltage power source 4, and the return cable 4*b* is connected to the ground (grounded) via a grounding line 6. Therefore, the opposed electrodes 3 are grounded.

The condenser units 5 need not be condenser elements integrally formed as electronic parts, but may be members provided with insulators to serve as dielectrics (members structurally provided with required capacitances). For instance, the condenser units 5 may be configured of a single thin insulator, structures formed by connecting a metal member and an insulating member, or structures formed by connecting metal members to both ends of an insulating member. In more general terms, the condenser units 5 may be any structures which have required capacities and permit connection of the output cable 4*a* and the discharge needles 2.

Figure 2:
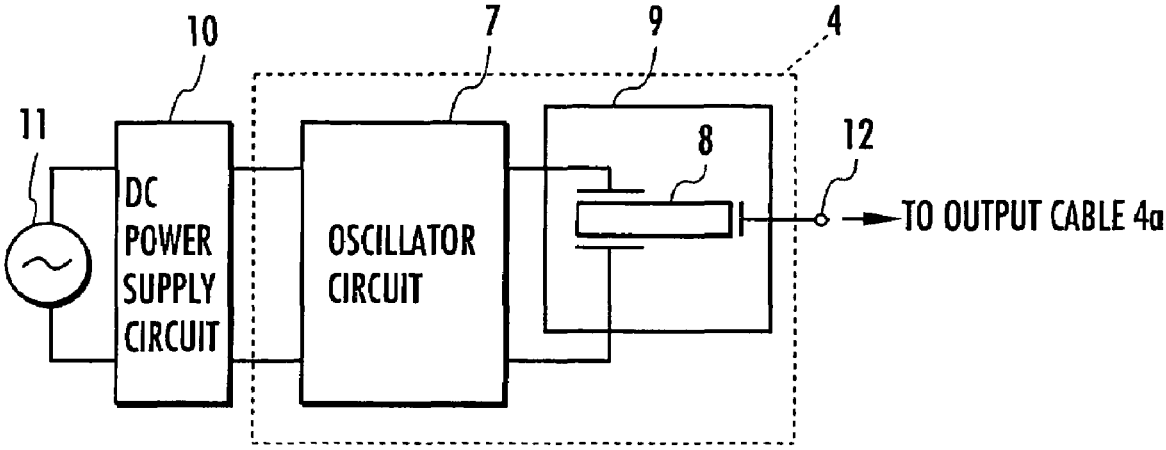
FIG. 2 is a circuit diagram of a high frequency AC high voltage power source shown in FIG. 1.

The high frequency AC high voltage power source 4, as shown in FIG. 2, comprises an oscillator circuit 7 which generates a high frequency AC voltage when a DC voltage is applied thereto, and a piezoelectric transformer 9 which boosts the generated high frequency AC voltage with a piezoelectric element 8 consisting of a piezoelectric ceramic to obtain a high voltage. The oscillator circuit 7 is connected to a DC power supply circuit 10 which generates a DC voltage from commercial power 11, and a DC voltage is applied thereto from the DC power supply circuit 10. The piezoelectric transformer 9 generates a high frequency high voltage as the piezoelectric element 8 mechanically vibrates in response to the output of the oscillator circuit 7, and outputs the high frequency high voltage from a terminal 12 to the output cable 4*a*. The frequency of the high frequency high voltage outputted from the piezoelectric transformer 9 is a high frequency in the range of 10 kHz to 100 kHz in this mode for implementation. Incidentally, with a view to prevent the vibration of the piezoelectric element 8 from generating noise, it is preferable for the frequency of the high frequency high voltage outputted from the piezoelectric transformer 9 to be 20 kHz or above.

To add, as the frequency of the high frequency high voltage outputted from the piezoelectric transformer 9 is raised, the high frequency high-voltage becomes lower. When its frequency is set to 100 kHz, the magnitude (amplitude) of the high frequency high voltage approaches the limit of voltage at which the discharge needles 2 can generate a corona discharge (about 1.8 kV). For this reason, the upper limit of the frequency of the high frequency high voltage outputted from the piezoelectric transformer 9 is set to 100 kHz in this mode for implementation.

In the ion generator 1 of the above-described circuit configuration, when a high frequency high voltage is applied to the discharge needles 2 by the high frequency AC high voltage power source 4, an electric field is formed between the discharge needles 2 and the opposed electrodes 3, and corona discharges are generated from the discharge needles 2 to enable positive and negative air ions to be generated.

Next, as a more specific embodiment of the ion generator 1 in the first mode for implementation having the circuit configuration of FIG. 1, an air nozzle type ion generator 1*a* will be described with reference to FIG. 3 and FIG. 4.

Figure 3:
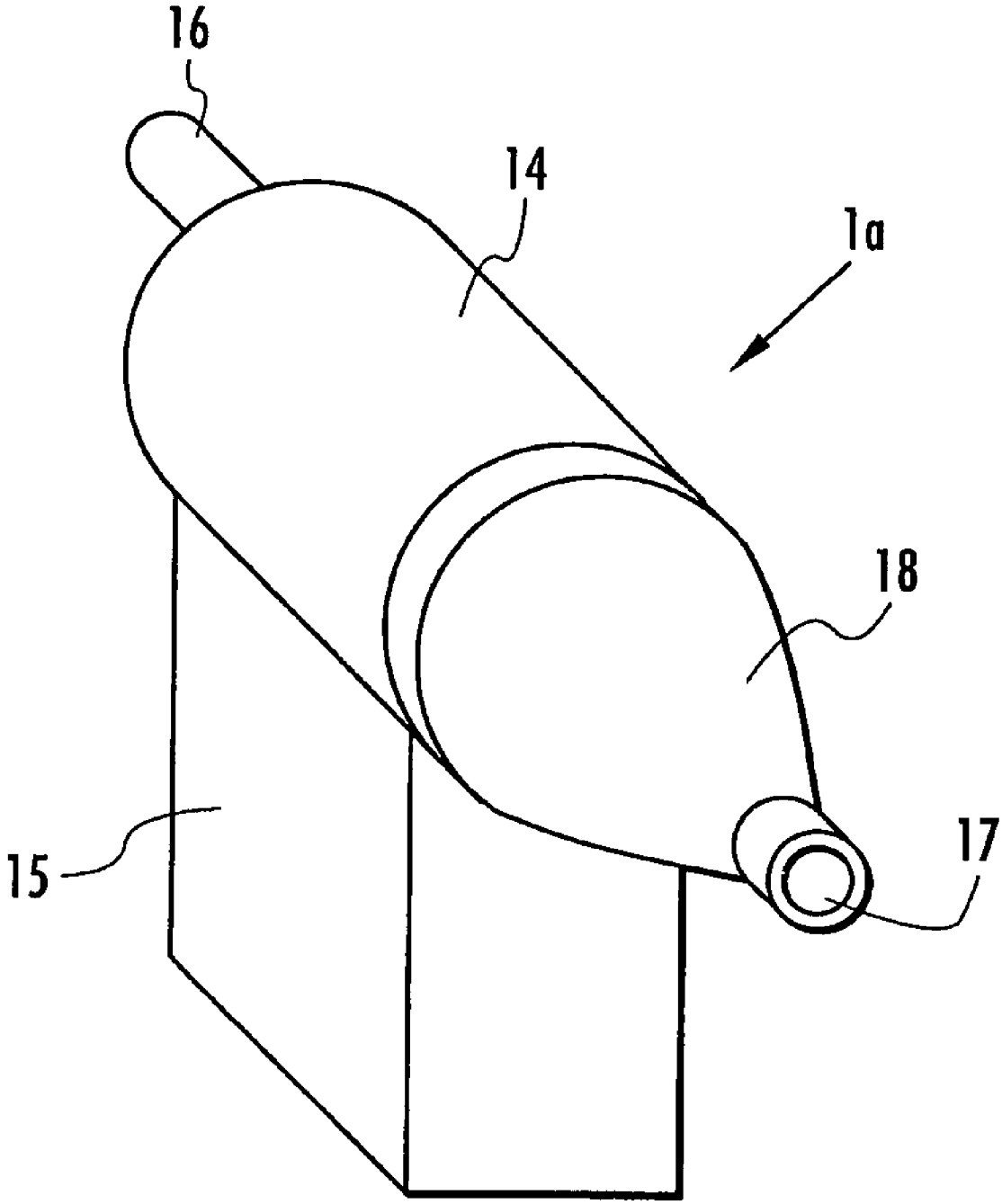
FIG. 3 shows an external perspective view of an air nozzle type ion generator in the first mode for implementation.
Figure 4:
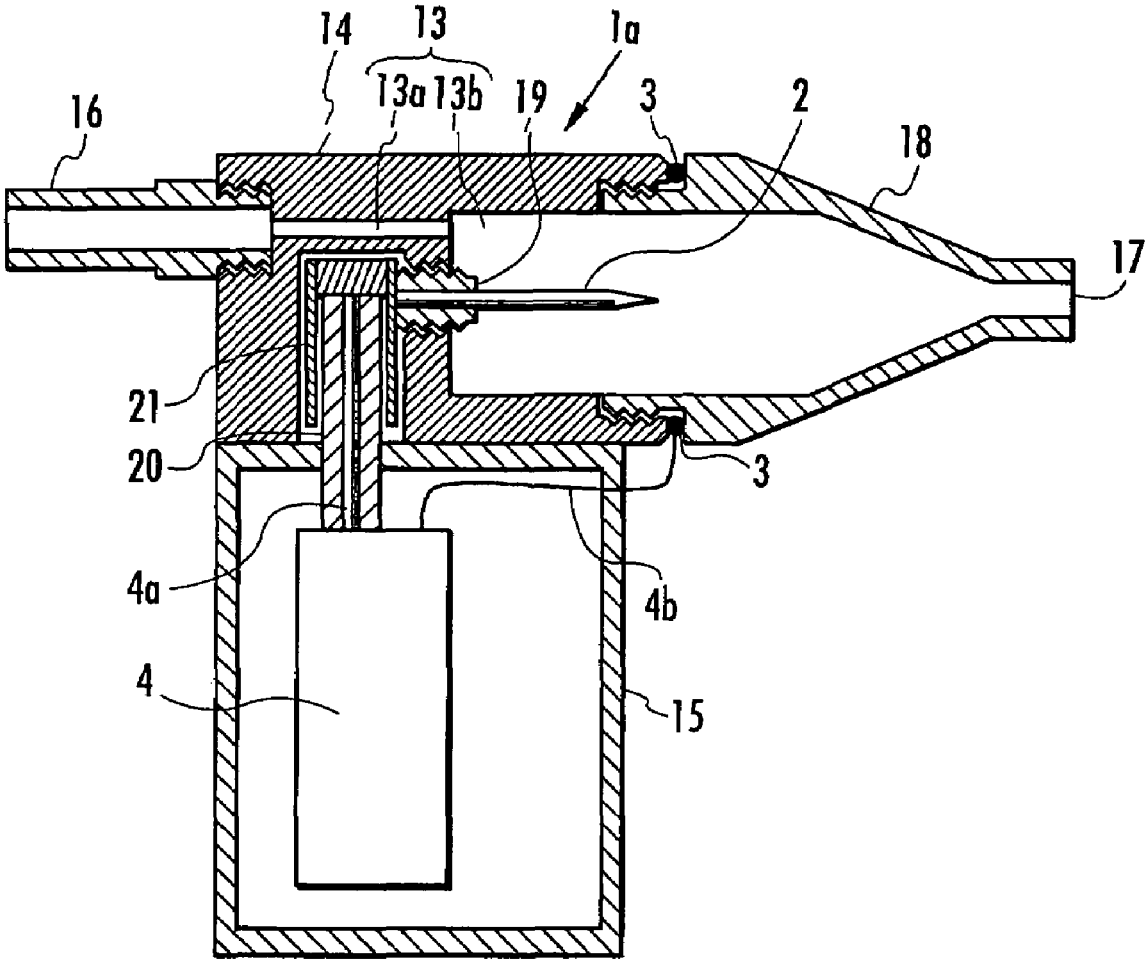
FIG. 4 illustrates the device shown in FIG. 3 along a longitudinal section.

As shown in FIG. 3 and FIG. 4, the air nozzle type ion generator 1*a* comprises a nozzle body 14 formed of an insulator, cylindrically shaped with an air passage 13 penetrating inside thereof in the axial direction and one discharge needle 2 implanted therein, an opposed electrode 3 disposed circularly along the outlet edge (one end of the nozzle body 14) of the air passage 13, and a power source case 15 which, having the high frequency AC high voltage power source 4 built therein, is fixed on an external face (the under face in FIG. 3 and FIG. 4) of the nozzle body 14.

An air feed pipe 16, connected to an air supply device not shown, is screwed onto the inlet to the air passage 13 of the nozzle body 14. A metal-made nozzle cap 18, at the tip of which an air outlet 17 is formed, is screwed onto the outlet of the air passage 13, so disposed that the opposed electrode 3 is held between the nozzle cap 18 and the nozzle body 14. Therefore, the opposed electrodes 3 and the nozzle cap 18 are in contact with each other to have electrical conduction therebetween.

The air passage 13 in the nozzle body 14 is straight and has a round cross-section from its inlet to outlet, but the air passage 13*b* on the outlet side, constituting the part from midway to the outlet, is made larger in diameter than the air passage 13*a* on the inlet side. And the central axis of the air passage 13*a* on the inlet side is positioned above the central axis of the air passage 13*b* on the outlet side (closer to the side of the nozzle body 14 opposite to the power source case 15) enlarged in diameter.

The discharge needle 2 is so screwed onto the nozzle body 14 via a metal-made socket 19 that its axis coincides with the central axis of the air passage 13*b* and of the nozzle cap 18 and its tip is positioned at the center of the opposed electrode 3.

The output cable 4*a* of the high frequency AC high voltage power source 4 in the power source case 15 is covered with an insulative covering member 20 and, together with the insulative covering member 20, fixed into a metal-made current collector ring 21. And the output cable 4*a*, the insulative covering member 20 and the current collector ring 21 are inserted into the nozzle body 14 from the power source case 15 side in the direction orthogonally crossing the axis of the discharge needle 2. The output cable 4*a*, the insulative covering member 20 and the current collector ring 21 are so extended within the nozzle body 14 that the outer circumferential face of the current collector ring 21 comes into contact (establishes electrical conduction) with the rear end of the discharge needle 2 and the socket 19 fitted to the rear end thereof. The insulative cover 20 and the current collector ring 21 here constitute the condenser unit 5 in FIG. 1. Namely, the insulative cover 20 as the insulator is placed intervening between the output cable 4*a* of the high frequency AC high voltage power source 4 and the discharge needle 2. In other words, when the output cable 4*a* which is a conductor serving as the core wire is provided with the insulative cover 20 consisting of an insulator, and establishing conduction from the outer circumferential face of the current collector ring 21 which covers the outside thereof and consists of a conductor to discharge needle 2, the discharge needle 2 is capacitance-coupled with the output cable 4*a* by the current collector ring 21 and the insulative covering member 20.

Also, the return cable 4*b* of the high frequency AC high voltage power source 4 is directly connected from the power source case 15 to the opposed electrode 3 to be in conduction with the opposed electrode 3. The opposed electrode 3, as described, is in contact and conduction with the nozzle cap 18. The nozzle cap 18, as it is metal-made and in conduction with the opposed electrode 3, can function, together with the opposed electrode 3 to which the return cable 4*b* is connected, as an electrode opposite the discharge needle 2. Thus, corona discharging is made possible between the discharge needle 2 and the nozzle cap 18.

In the nozzle type ion generator 1*a* of the configuration described above, when a high voltage (about 2 kV) of a high frequency of 10 to 100 kHz is applied to the discharge needle 2 by the high frequency AC high voltage power source 4, an electric field is formed between the discharge needles 2 and the nozzle cap 18. Then the electric field concentrates on the tip of the discharge needle 2 to generate a corona discharge to give rise to positive and negative air ions. Also, air is supplied from an air supply device not shown to around the discharge needle 2 via the air feed pipe 16 and the air passage 13. Since the air ions generated in the space in the tip part of the discharge needle 2 are transferred as a result, air containing the air ions is ejected from the ion outlet 17. And the static electricity of a charged object positioned in front of the ion outlet 17 can be neutralized (removed).

In the first mode for implementation described above, the discharge needle 2 for generating air ions is capacitance-coupled with the output cable 4*a* of the high frequency AC high voltage power source 4. As a result, the quantities of positive and negative air ions in the space near the tip of the discharge needle 2 can be substantially equalized thereby to keep a good ion balance between the positive and negative air ions. The following reason is conceivable for this result.

When the quantity of negative air ions is greater than that of positive air ions in the space near the tip of the discharge needle 2, positive air ions remain in the discharge needles 2 because the condenser unit 5 intervenes between the discharge needles 2 and the output cable 4*a* of the high frequency AC high voltage power source 4 to bring the potential of the discharge needle 2 toward the positive side. For this reason, when a positive voltage is applied to the discharge needle 2, the potential difference between the discharge needle 2 and the opposed electrode 3 widens, and the generated quantity of positive air ions increases. Conversely, when a negative voltage is applied to the discharge needles 2, the potential difference between the discharge needle 2 and the opposed electrode 3 narrows, and the generated quantity of negative air ions decreases. Conceivably as a result of these phenomena, the quantities of positive and negative air ions in the space near the tip of the discharge needle 2 are substantially equalized. And even if there are more positive air ions than negative air ions in the space near the tip of the discharge needle 2, the same process as what was described above is likely to make adjustment to eliminate the unevenness of the quantities of positive and negative air ions.

Also, the condenser unit 5 can be configured to have such a capacitance as will make the voltage drop (the voltage drop in the condenser unit 5) at the time of corona discharging to be sufficiently small (a capacitance that allows the discharge needle 2 to generate a corona discharge without any trouble).

For instance, the diameter of the output cable 4*a* is set to 2 mm, the thickness of the insulative covering member 20 to 1 mm, the bore of the current collector ring 21 to 4 mm and the length of the current collector ring 21 to 20 mm. Further, the specific inductive capacity of the insulative covering member 20 is set to 5.0. In this case, the capacitance of the condenser units 5 will be about 8.4 pF, and its impedance is between about 2 MΩ and 0.2 MΩ in the range of 10 kHz to 100 kHz. And since the discharge amperage of one discharge needle 2 at the time of corona discharging is about 3 μA to 10 μA , the voltage drop in the condenser unit 5 can be restrained to 2 V or less at any frequency in the range of 10 kHz to 100 kHz. And, since this voltage drop is sufficiently smaller than the output voltage that can be generated by the high frequency AC high voltage power source 4 (2 to 3 kV), a voltage not lower than the voltage needed for corona discharging (a voltage of about 1.8 kV in amplitude) can be applied to the discharge needle 2 without any trouble.

Also, since the current that can be outputted by the piezoelectric transformer 9 is at most 100 μA, the short-circuiting current that occurs when something comes into contact with the discharge needle 2 can be kept sufficiently small irrespective of the capacitance of the condenser unit 5.

Also, even if a drift or the like occurs in the high frequency AC high voltage power source 4 and a DC component is contained in the high voltage current supplied from the high frequency AC high voltage power source 4 to the discharge needle 2, it can be cut by the condenser unit 5. For this reason, it is possible to provide an ion generator which can secure the stability of the ion balance and excels in deelectrifying capability.

To add, though a nozzle type ion generator to which air is fed from outside via the air feed pipe 16 was described above as an example of this mode for implementation, an air blowing type device in which generated air ions are transferred by a fan can give the same effect if the configuration of the electrical circuit shown in FIG. 1 and FIG. 2 is the same.

Figure 5:
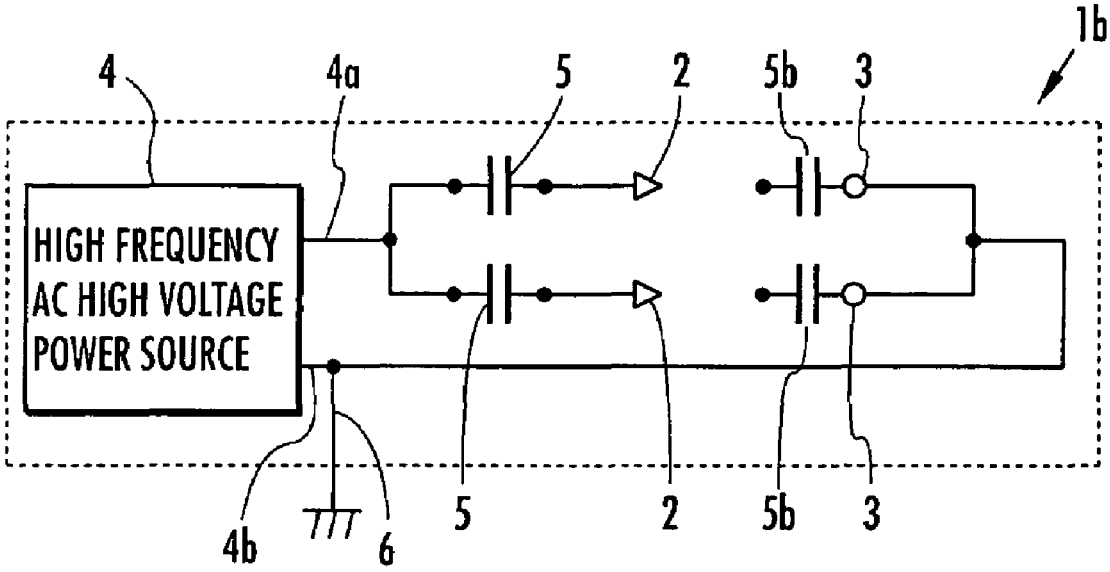
FIG. 5 is a circuit diagram showing an outline of an ion generator in a second mode for implementing the invention.
Figure 6:
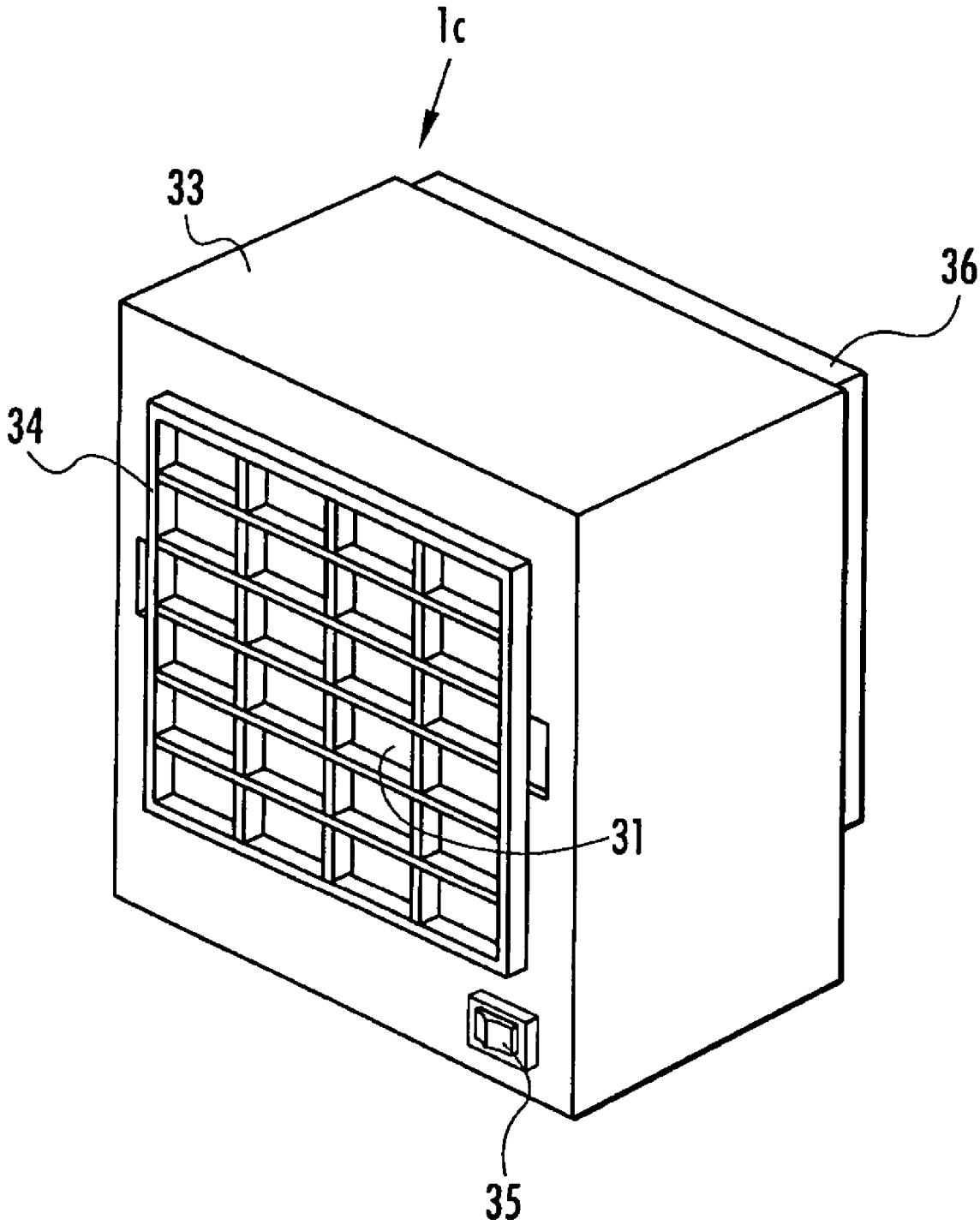
FIG. 6 shows an external perspective view of an air blowing type ion generator in the second mode for implementation.

Next will be described an ion generator in a second mode for implementing the present invention with reference to FIG. 5. An ion generator 1*b* in the second mode for implementation, as shown in FIG. 5, has the same circuit configuration as the ion generator 1 in the first mode for implementation except for condenser units 5*b* (capacitance units). Therefore, the same constituent parts as in the ion generator 1 will be assigned respectively the same reference numerals, and their description will be dispensed with.

The condenser units 5*b* are connected to the opposed electrodes 3 in a state of being opposed to the discharge needles 2. Therefore, the current at the time of corona discharging between the discharge needles 2 and the opposed electrodes 3 flows via the condenser units 5*b*. These condenser units 5*b* need not be condenser elements integrally formed as electronic parts, as in the case of the condenser unit 5, but may as well be members provided with insulators to serve as dielectrics (for instance, the same structures as the condenser units 5).

The ion generator 1*b* of the circuit configuration described above can generate positive and negative air ions when a high frequency high voltage is applied by the high frequency AC high voltage power source 4 to the discharge needles 2 as corona discharging takes place between the discharge needles 2 and the opposed electrodes 3 via the condenser units 5*b*.

Next will be described with reference to FIG. 6 through FIG. 10 an air blowing type ion generator 1*c* as a more specific embodiment of the ion generator 1*b* in the second mode for implementation, having the circuit configuration shown in FIG. 5.

Figure 7:
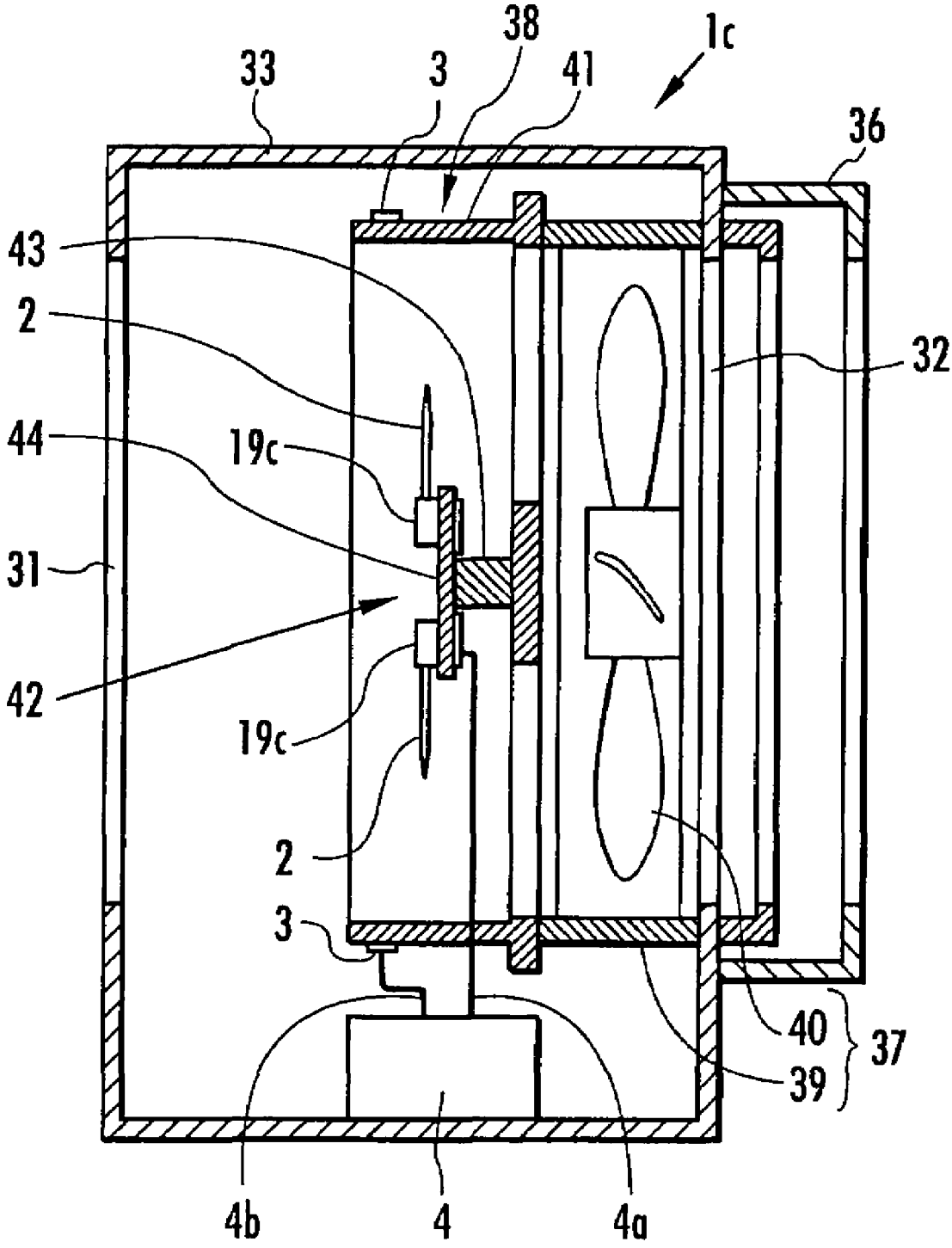
FIG. 7 illustrates the device shown in FIG. 6 along a longitudinal section.
Figure 8:
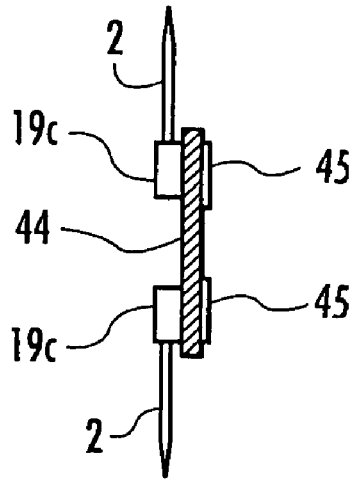
FIG. 8 through FIG. 10 illustrate an electrode shown in FIG. 7.

Referring to FIG. 6 through FIG. 10, the air blowing type ion generator 1*c* in the second mode for implementation comprises a case 33 having an air outlet 31 opened in its front face and an air inlet 32 in its rear face. The case 33 is made of metal for instance, but may as well be composed of an insulator. On the front face of the case 33 a louver 34 covering the outlet 31 and a power switch 35 are disposed, and on the rear face of the case 33 a filter set 36 covering the air inlet 32 is provided. And air is sucked in through the filter set 36, and air containing air ions generated within the case 33 are blown out through the louver 34. Incidentally, the louver 34 and the filter set 36 are configured to be detachable from the case 33. In FIG. 7, illustration of the louver 34 is dispensed with.

Within the case 33, blower means 37 and ion generator means 38 are arranged in that order from rear to front. The blower means 37, composed of a cylindrical fan housing 39 fixed to the air inlet 32 and a fan 40 housed in the fan housing 39 and driven by a motor not shown, blows air by the rotational driving of the fan 40 from the air inlet 32 toward the air outlet 31.

The ion generator means 38 comprises an air guide cylinder 41 (cylindrical insulator) consisting of an insulator and disposed in continuity to the front of the fan housing 39, the opposed electrodes 3 consisting of annular conductors fitted to the outer circumference of the air guide cylinder 41, a plurality of (eight in this mode for implementation) discharge needles 2 radially arranged within the air guide cylinder 41, spaced from one another around the axis of the opposed electrodes 3 (the axis of the air guide cylinder 41), and an electrode holder 42 for holding the base ends of these discharge needles 2. The axes of the opposed electrodes 3 and the air guide cylinder 41 coincide with the axis of rotation of the fan 40.

The electrode holder 42, arranged in the central part of the air ion guide cylinder 41, comprises a round substrate 44 (plate-shaped insulator) formed of an insulator, whose rear face is supported and fixed by the air ion guide cylinder 41 via a supporting member 43, eight metal-made (electroconductive) sockets 19*c* radially arranged in a fixed manner on the front face of the substrate 44 matching the arrangement of the discharge needles 2, and a circuit pattern 45 (pattern of an electroconductive thin film layer) formed on the rear face of the substrate 44 in a pattern matching the arrangement of the sockets 19*c*. The eight sockets 19*c* correspond to the first conductor pattern in the context of the present invention, while the circuit pattern 45 corresponds to the second conductor pattern in the context of the invention. The sockets 19*c* correspond to the partial conductor constituting the first conductor pattern. Incidentally, the substrate 44 may have circuit patterns formed on the two faces.

The substrate 44, with its central axis (the axis in the normal direction) kept coinciding with the axes of the opposed electrodes 3 and of the air guide cylinder 41, is disposed in the central part of the air guide cylinder 41.

Figure 9:
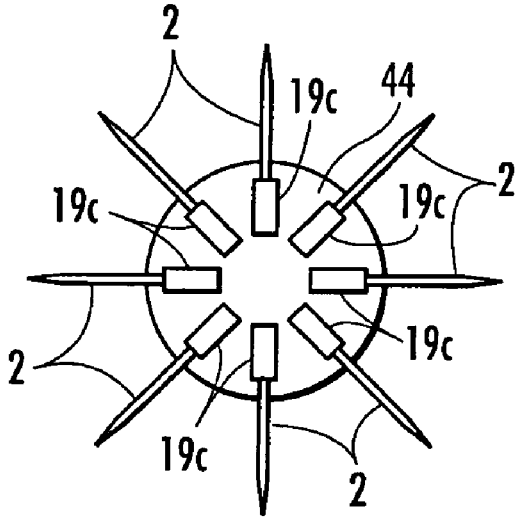

The eight sockets 19*c*, as shown in FIG. 9, are fixed on the front face of the substrate 44 in a state in which they are insulated from one another by the substrate 44.

Figure 10:
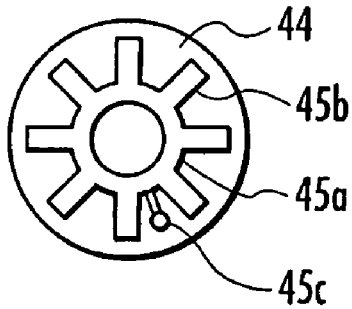

The circuit pattern 45, as shown in FIG. 10, comprises an annular portion 45*a* surrounding the central area of the rear face of the substrate 44 fixed to the supporting member 43, eight radial portions 45*b* in conduction with the annular portion 45*a* radially arrayed and formed in parts of the rear face of the substrate 44 and matching the sockets 19*c* (parts opposite the sockets 19*c* in the direction of the thickness of the substrate 44), and a cable connecting part 45*c* in conduction with the annular portion 45*a* between the adjoining radial portions 45*b* and 45*b*. The radial portions 45*b* are in conduction with one another via the annular portion 45*a*. Incidentally, the annular portion 45*a* and the radial portions 45*b* correspond to the partial conductors of the second conductor pattern in the context of the invention.

And as shown in FIG. 7, the output cable 4*a* of the high frequency AC high voltage power source 4 arranged on the inner bottom region of the case 33 is connected to the cable connecting part 45*c* of the circuit pattern 45. The base of each discharge needle 2 is inserted into and fixed in each socket 19*c* of the electrode holder 42 with the axis of the discharge needle 2 oriented to the radial direction of the substrate 44. Here, the sockets 19*c*, the substrate 44 and the circuit pattern 45 constitute the condenser units 5 shown in FIG. 5. The condenser units 5 in this case, with the sockets 19*c* and the circuit pattern 45 serving as electrodes, have functions of parallel plate condensers using the substrate 44 intervening between these electrodes as a dielectric. In more detail, the parallel plate condenser is formed with the sockets 19*c* and the radial portions 45*b* of the circuit pattern 45 opposing thereto serving as electrodes and the substrate 44 between these electrodes as a dielectric. In other words, the discharge needles 2 are capacitance-coupled with the output cable 4*a* of the high frequency AC high voltage power source 4 by the sockets 19*c* fixing them and the substrate 44 which is an insulator between the sockets 19*c* and the radial portions 45*b* opposite them.

Also, the return cable 4*b* of the high frequency AC high voltage power source 4 is connected to (in conduction with) the opposed electrodes 3. Since the opposed electrodes 3 here are fitted to the outer circumference of the air guide cylinder 41 formed of an insulator, the surfaces of the opposed electrodes 3 opposite the discharge needles 2 are covered by an insulator (the air guide cylinder 41). Also, as the air guide cylinder 41 is connected to the opposed electrodes 3 opposite the tips of the discharge needles 2, the guide cylinder 41 constitutes the condenser units 5*b* of FIG. 5.

In the air blowing type ion generator 1*c* of the above-described configuration, when a high voltage (about 2 kV) of a high frequency of 10 to 100 kHz is applied by the high frequency AC high voltage power source 4 to the discharge needles 2, corona discharging takes place between the discharge needles 2 and the opposed electrodes 3 via the air guide cylinder 41 to generate positive and negative air ions. And when air is blown by the rotational driving of the fan 40 from the air inlet 32 to the air outlet 31, the air sucked via the filter set 36 is guided by the air guide cylinder 41 to be supplied to the vicinity of the discharge needles 2. Since the air ions then generated in the space near the tip part of the discharge needle 2 is transferred to the front side of the case 33, air containing the air ions is supplied through the louver 34. And the static electricity of a charged object positioned in a remote position can be neutralized and removed.

In the second mode for implementation described above, not only the same effect as in the first mode for implementation can be achieved but also, as the condenser units 5*b* are provided, the ion balance between positive and negative air ions (in more detail, the balance between positive and negative air ions which are transferred to the front side of the case 33 without being captured by the air guide cylinder 41 or anything else) is further improved. The conceivable reason for this is as follows.

Thus, even if the positive and negative air ions generated in the space near the tip region of the discharge needles 2 are balanced in equal quantities, if the quantities of positive and negative ions directed toward the opposed electrodes 3 differ, the balance between the quantities of positive and negative ions supplied to the outside of the case 33 may be lost. However, since the condenser units 5*b* are provided in this mode for implementation, if positive air ions directed to the opposed electrodes 3 increase, the potential on the inner circumference of the air guide cylinder 41 which constitutes the condenser units 5*b* fitted with the opposed electrodes 3 becomes more dominantly positive. For this reason, when a positive voltage is applied to the discharge needles 2, the difference in potential between the discharge needles 2 and the inner circumference of the air guide cylinder 41 becomes smaller, and the quantity of positive air ions generated decreases. As a result, the quantity of positive air ions supplied to the outside of the case 33 decreases. Conversely, when negative air ions directed to the opposed electrodes 3 increase, the potential on the inner circumference of the air guide cylinder 41 becomes more dominantly negative. For this reason, when a negative voltage is applied to the discharge needles 2, the difference in potential between the discharge needles 2 and the inner circumference of the air guide cylinder 41 becomes smaller, and the quantity of negative air ions generated decreases. As a result, the quantity of positive ions supplied to the outside of the case 33 decreases. This conceivably causes the quantities of the positive and negative air ions directed to the opposed electrodes 3 to be balanced, resulting in balancing of the quantities of positive and negative ions supplied to outside the case 33 as well.

To add, the condenser units 5 in this mode for implementation can obviously be configured to have such capacitances as will make the voltage drop (the voltage drop in the condenser units 5) at the time of corona discharging to be sufficiently small, and an example of this configuration will be shown below.

If, for instance, a phenol resin-made substrate (about 5 in specific inductive capacity) of 1 mm in thickness is used as the substrate 44, and to set the area of each radial portion 45*b* of the circuit pattern 45 to be $113\times10^{-6}$ $m^2$ for example. The capacitance of the condenser unit 5 for each discharge needle 2 then will be about 5 pF. The impedance of the condenser unit 5 is about 3 MΩ to 0.3 MΩ in the range of 10 kHz to 100 kHz. And since the discharge amperage of one discharge needle 2 at the time of corona discharging is about 3 μA to 10 μA, the voltage drop in the condenser unit 5 can be restrained to 3V or less at any frequency in the range of 10 kHz to 100 kHz. As this voltage drop is sufficiently smaller than the output voltage that can be generated by the high frequency AC high voltage power source 4 (2 to 3 kV), a voltage not lower than the voltage needed for corona discharging (a voltage of about 1.8 kV in amplitude) can be applied to the discharge needle 2 without any trouble.

To add, though an air blowing type ion generator was described above as an example of the second mode for implementation, a nozzle type device like the one described above with reference to the first mode for implementation can give the same effect if the configuration of the electrical circuit is the same as what is shown in FIG. 5.

Ion generators according to the invention are not limited to the devices referred to in describing the first and second modes for implementation above, but the material, shape and size for configuration of the condenser units 5 or 5*b* can be appropriately selected otherwise. In this case, in order to cause the discharge needles 2 to accomplish corona discharging, a voltage of not less than about 1.8 kV has to be provided to the discharge needles 2. Also since, the output voltage of the high frequency AC high-voltage power source 4 (the voltage generated on the output cable 4*a*) is about 2 to 3 kV, it is preferable for the voltage between the output cable 4*a* and the discharge needles 2 at the time of corona discharging to be kept at no higher than about 100 V at the maximum. And since the discharge amperage at the time of corona discharging is about 3 to 10 μA, in order to keep the voltage drop of the condenser units 5 at about 100 V, the impedance of the condenser units 5 has to be kept at no more than 10 MΩ at the maximum. Therefore, it is desirable for the capacitances of the condenser units 5 to be so set as to keep the impedance at no more than 10 MΩ at a frequency of 10 to 100 kHz. Such capacitances can be realized with no trouble by the structure of the condenser units 5 described above with reference to the first and second modes for implementation. For instance, the capacitances may be from 0.1 to 10 pF approximately. To add, the greater the capacitances of the condenser units 5, the greater the areas of the condenser units 5 (the areas contributing to the capacitances) will have to be. Accordingly, considering the dimensions of the condenser units 5, it is desirable for the capacitances of the condenser units 5 to be no more than about 10 pF at the maximum for practical purposes.

Figure 11:
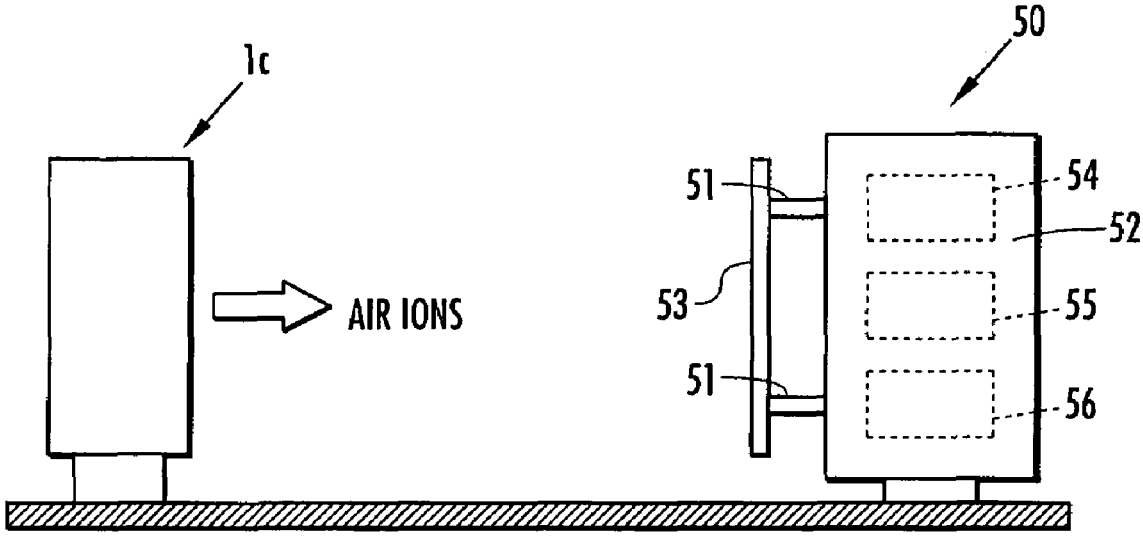
FIG. 11 is a configuration diagram of a testing apparatus for the device shown in FIG. 6.

With respect to a case in which the condenser units 5 of the air blowing type ion generator 1*c* in the second mode for implementation described above has a preferable level of static capacitances, the performance of the device will be described. Referring to FIG. 11, the inventors pertaining to the present application conducted a test to check the deelectrifying effect of this air blowing type ion generator 1*c* by using a charged plate monitor 50. The charge plate monitor 50 comprises a metal plate 53 fitted to its body 52 via an insulating member 51, and has within the body 52 a surface potential measuring device 54 for measuring the potential of the metal plate 53, a high-voltage power source 55 for providing an electric charge to the metal plate 53, and a timer 56 for measuring the varying time of the potential of the metal plate 53.

First, the metal plate 53 of 150 mm square was arranged in a position at a distance of 300 mm from the air blowing type ion generator 1*c* (Example). And the metal plate 53 was charged with +1000 V (or −1000 V) by the high voltage power source 55.

First, an AC voltage of 68 kHz, 2 kV (0−p) was applied to the discharge needles 2 by the high frequency AC high voltage power source 4 of the air blowing type ion generator 1*c* to cause positive and negative air ions to be generated by corona discharging, and the generated air ions were supplied from the air blowing type ion generator 1*c* to the metal plate 53. And the charge of the metal plate 53 was neutralized by the supply, and the length of time taken by the potential of the metal plate 53 to attenuate from the initial voltage of +1000 V (or −1000 V) to +100 V (or −100 V) was measured as the attenuation time. The result of measurement is shown in Table 1. To add, when the ion generator of Comparative Example for comparison with Example was used, the attenuation time was measured in the same way as described above. The device of Comparative Example used for the measurement is an air blowing type device provided with the high frequency AC high voltage power source 4 and has the same configuration as the air blowing type ion generator 1*c* except that it uses directly connected type electrodes of a structure in which the discharge needles 2 and the output cable 4*a* are directly connected (provided with the air guide cylinder 41 for covering the opposed electrodes 3). The result of measuring this Comparative Example is shown in Table 1 together with that of Example.

TABLE 1

| | Example | Comparative Example |
|---|---|---|
| Attenuation time +1000 → +100 (sec) | 1.8 | 1.9 |
| Attenuation time −1000 → −100 (sec) | 1.9 | 2.0 |
| Offset voltage (V) | +1 to +2 | −2 to +10 |

Next, with the metal plate 53 being used as the charged object, air containing air ions was continuously blown on the metal plate 53 of the charged plate monitor 50 from the air blowing type ion generator 1*c*. In this procedure, the voltage attributable to the charge accumulated on the metal plate 53 was consecutively measured as the offset voltage with the surface potential measuring device 54. The offset voltage serves as the indicator of the balance between the quantities of positive and negative air ions (ion balance) discharged from the air blowing type ion generator 1*c* to the metal plate 53. As the absolute value of the offset voltage increases when the quantities of positive and negative air ions discharged from the air blowing type ion generator 1*c* are uneven, a smaller absolute value of the voltage indicates a correspondingly good ion balance. To add, where the device of the aforementioned Comparative Example was used, the offset voltage was measured in the same way as described above.

Figure 12:
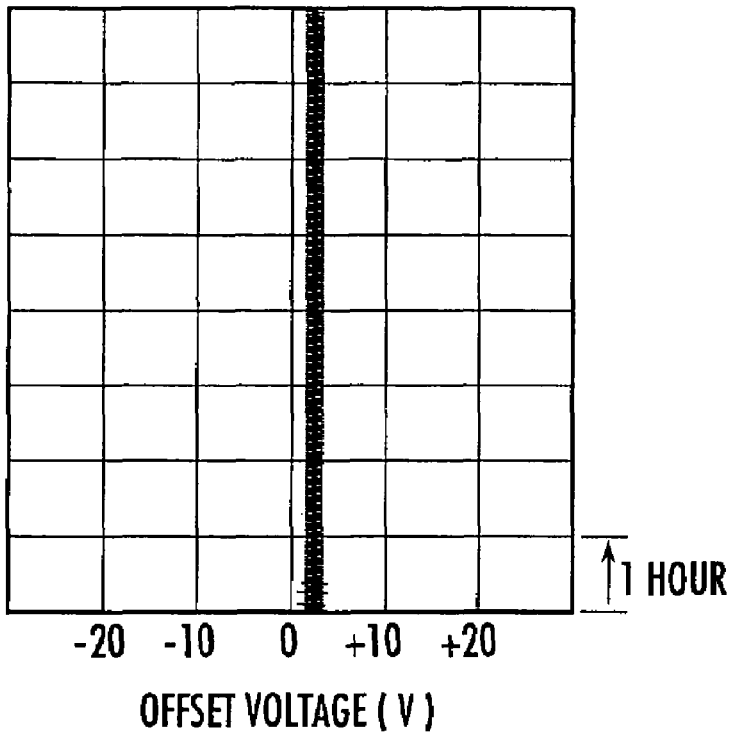
FIG. 12 is a graph showing the performance of the device shown in FIG. 6.
Figure 12:
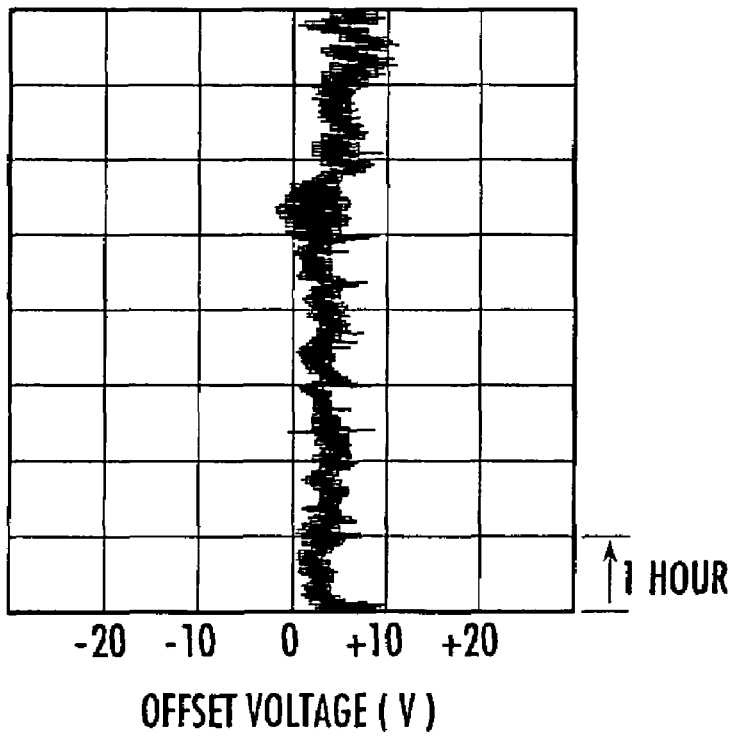

The result of measurement of this offset voltage is shown in Table 1 cited above and FIG. 12. In FIG. 12, the vertical axis represents the operating duration [h] of the air blowing type ion generator and the horizontal axis represents the offset voltage [V], FIG. 12(*a*) shows the test result of Example and FIG. 12(*b*) shows the test result of Comparative Example.

As referencing Table 1 would make it evident, though the attenuation time is substantially equal between the Example and the Comparative Example, the margin of variation of the offset voltage is found far smaller in the Example than in the Comparative Example. Moreover, the offset voltage in the Example is kept to a voltage substantially close to 0. Further, the variations in offset voltage over time, as shown in FIG. 12, are evidently more stable in the Example than in the Comparative Example. Therefore, the ion balance of positive and negative air ions discharged from the ion generator 1*c* toward the metal plate 53 is evidently better than in the device of Comparative Example.

INDUSTRIAL APPLICATION

As hitherto described, the ion generator according to the present invention is useful as what can so generate positive and negative air ions that various charged objects can be effectively deelectrified, and suitable for deelectrifying charged objects, such as semiconductor devices, which require a high deelectrifying effect.

The invention claimed is:

1. An ion generator, comprising at least one discharge needle, an opposed electrode opposite the discharge needle, and an AC high voltage power source for applying a high voltage between the discharge needle and the opposed electrode, for generating positive and negative air ions by giving rise to a corona discharge when a high voltage is applied between the discharge needle and the opposed electrode by the AC high voltage power source, wherein the AC high voltage power source comprises a high frequency oscillator and a piezoelectric transformer, and outputs a high frequency voltage, and an insulator is placed intervening between the high voltage output line of said AC high voltage power source and the discharge needle, thereby establishing a capacitive coupling between said AC high voltage power source and said discharge needle, to enable the discharge needle to accomplish discharging.

2. The ion generator according to claim 1, wherein the high voltage output line of said AC high voltage power source is covered with an insulating tube as said insulator, the high voltage output line covered with this insulating tube is inserted into a current collector ring formed of a conductor in a state in which the high voltage output line is insulated from the current collector ring by the insulating tube, and conduction is established between the surface of the current collector ring into which the high voltage output line is inserted and said discharge needle.

3. The ion generator according to claim 1, wherein conduction of said discharge needle is established with a first conductor pattern formed on one face of the plate-shaped insulator as said insulator, and conduction of said high voltage output line is established with a second conductor pattern formed on the other face of the plate-shaped insulator in a position matching the first conductor pattern.

4. The ion generator according to claim 3, wherein a plurality of said discharge needles are provided, said first conductor pattern comprises a plurality of partial conductors establishing conduction of the discharge needles with one another arranged on one face of the plate-shaped insulator in a pattern in which the partial conductors are insulated from one another by said plate-shaped insulator and matched with the arrangement of the plurality of discharge needles, and said second conductor pattern comprises a plurality of partial conductors opposite the partial conductors of the first conductor pattern via the plate-shaped insulator and a partial conductor linking this plurality of partial conductors in conduction with one another.

5. The ion generator according to claim 4, wherein a plurality of the discharge needles, with the base end of each being fixed to the partial conductors of the first conductor pattern on the plate-shaped insulator 1, are laid extending around the plate-shaped insulator in a pattern of arrangement radiating from the plate-shaped insulator, and said opposed electrode is composed of an annular conductor so arranged around the plurality of discharge needles as to have an axis in a direction substantially orthogonal to the axis of each discharge needle.

6. The ion generator according to claim 1, wherein the surface of said opposed electrode facing the discharge needles is covered with an insulator.

7. The ion generator according to claim 5, wherein the opposed electrode which is said annular conductor is fitted to the outer circumference of a cylindrical insulator, the cylindrical insulator accommodating therein a plurality of the discharge needles and the plate-shaped insulator and being arranged coaxially with the annular conductor, and comprises, within the cylindrical insulator, means of supplying air in the axial direction thereof.

8. The ion generator according to claim 2, wherein the surface of said opposed electrode facing the discharge needles is covered with an insulator.

9. The ion generator according to claim 3, wherein the surface of said opposed electrode facing the discharge needles is covered with an insulator.

10. The ion generator according to claim 4, wherein the surface of said opposed electrode facing the discharge needles is covered with an insulator.

11. The ion generator according to claim 5, wherein the surface of said opposed electrode facing the discharge needles is covered with an insulator.

* * * * *